US006131194A

United States Patent [19]

Ardura Gonzalez

[11] Patent Number: 6,131,194

[45] Date of Patent: Oct. 17, 2000

[54] SAFEGUARD DEVICE FOR PLAYING GOLF

[76] Inventor: Manuel Ardura Gonzalez, Avda. Pio XII, 55, bajo 5, E-28016, Madrid, Spain

[21] Appl. No.: 09/292,677

[22] Filed: Apr. 16, 1999

[30] Foreign Application Priority Data

Jul. 27, 1998 [ES] Spain ..... 9802003

[51] Int. Cl.[7] ..... A41D 17/00

[52] U.S. Cl. ..... 2/22; 2/46; 2/242; 36/2 R; 36/1.5

[58] Field of Search ..... 2/22–24, 46, 242, 2/231; 128/882; 602/27, 62; 36/1.5, 2 R

[56] References Cited

U.S. PATENT DOCUMENTS

| | | | |
|---|---|---|---|
| 2,406,090 | 8/1946 | Mas | 36/2 R |
| 2,872,745 | 2/1959 | Finegan | 36/2 R |
| 3,153,864 | 10/1964 | Brewer | 36/2 R |
| 5,613,250 | 3/1997 | Bell | 2/242 |
| 5,815,948 | 10/1998 | Dzielak | 36/2 R |
| 5,887,359 | 3/1999 | Falguere | 36/2 R |
| 5,970,525 | 10/1999 | Gallinto et al. | 2/242 |

FOREIGN PATENT DOCUMENTS

| | | |
|---|---|---|
| 0329621 | 8/1989 | European Pat. Off. . |
| 0852916 | 7/1998 | European Pat. Off. . |

*Primary Examiner*—John J. Calvert
*Assistant Examiner*—Tejash Patel
*Attorney, Agent, or Firm*—Browdy and Neimark

[57] ABSTRACT

A safeguard element for playing golf or other sports requiring such protection comprising a set of two units, one for each leg, of waterproof textile material and suitably shaped to adapt to the player's legs, over the shoe to the bottom of the calf, secured to the leg at the back in line with the Achilles tendon, using attachment devices such as hook and loop fastner, removable adhesive, zips, hooks and eyes, ribbons or combinations thereof and also able to be simply sewn on to a pair of trousers, overall or the like, as an integral part.

5 Claims, 2 Drawing Sheets

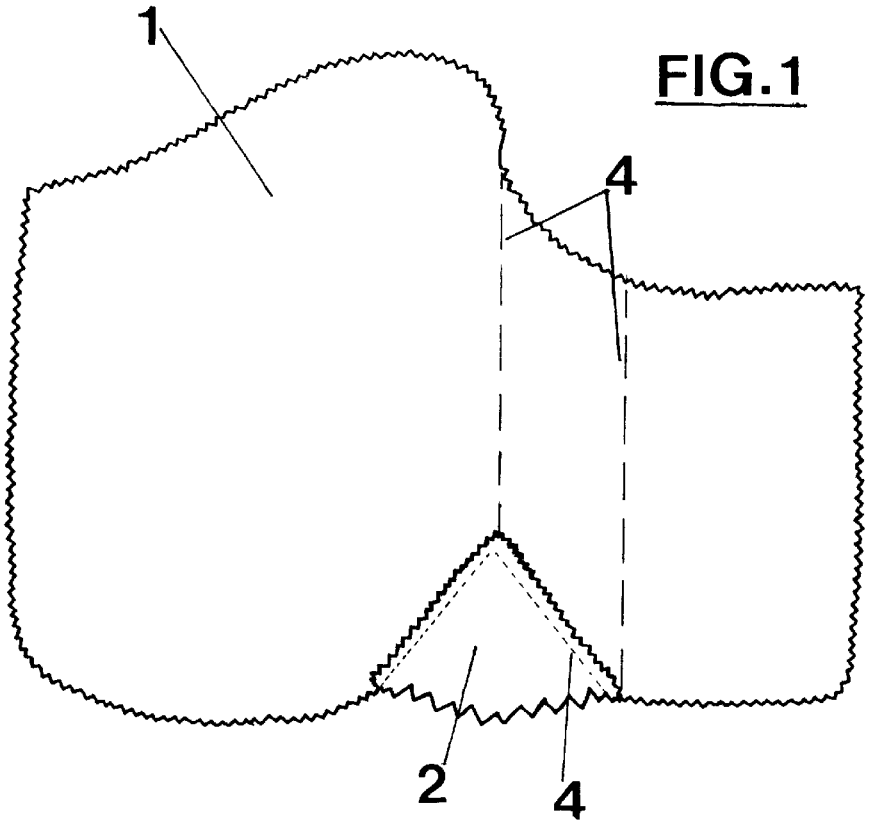
FIG.1
FIG.2
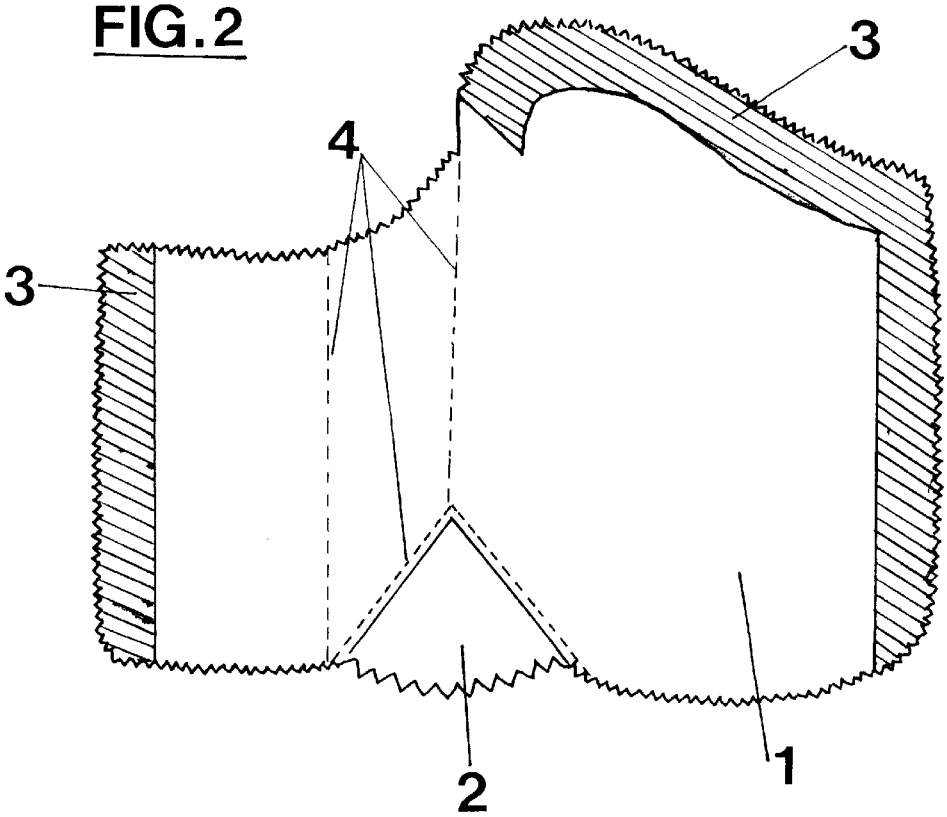

SAFEGUARD DEVICE FOR PLAYING GOLF

PURPOSE OF THE INVENTION

This invention refers to a safeguard device designed for the playing of golf, which might also be applied in other similar sports such as polo, cricket, etc. . . . which require such protection. It refers in particular to an assembly formed by two units which can be placed on each leg of the player's trousers, specifically on the lower part, to surround the entire perimeter of that area of the trousers, overlapping with the top of the shoe, and including releasable attachment devices to hold it in its operative position and which may of the conventional type or any other developed subsequently. Said safeguard element may equally be independent of the trousers or incorporated thereto during manufacture.

The field of application of the invention obviously comes within the industry of the manufacture of sports apparel and articles and, in particular, those for golf.

BACKGROUND OF THE INVENTION

It is known how golf players continually wet, stain and soil the bottom of their trouser legs when playing their sport, and sand and other particles may even get between the shoe and sock, because they play on grass, which is frequently watered, with areas of sand, mud, etc. . . . all of which causes permanent deterioration to the bottom of the trousers, the part most exposed, and representing a drawback, discomfort, cost and wear on the garment because of the frequency with which it must be cleaned. In addition, even in striking the ball, in each movement sand, mud or grass is raised, affecting that area and soiling it. The same thing happens when the ball falls into a sand trap which the player must enter to strike it, sinking the feet into the sand. It must also be remembered that a golf course comprises 18 holes, on each of which the ball must be struck between 3 and 5 times, which converts into 6 to 8 kilometres walking and playing, for between 4 and 6 hours, so that the bottom of the trousers and the textile with which they are made is dampened and dried several times over all this period so that the stains penetrate the fabric and are harder to remove.

One way of avoiding this problem would be to use a "water suit". This however has drawbacks, such as their awkwardness of use and, in particular the lack of suitability for the style and/or dress common when playing golf, which is an elite sport.

Another solution, put forward in the document of Spanish Patent No. 9800490 by the same inventor, consists of a system based on two articulated rigid or semi-rigid elements of a half-tube shape, covering the whole of the lower part of the leg including the shin. This system does not cover the entire lower rear of the trousers against soiling, while the component parts are somewhat awkward to store in a bag or the like because of their rigid or semi-rigid nature.

A SUMMARY OF THE INVENTION

This invention proposes as its main purpose to develop a simple element to overcome the practical drawbacks of the current art, referred to above.

In particular, the creation is proposed of a simple element which, worn on the bottom of the trouser leg, provides a safeguard against soiling while playing golf, and which is economical, easy to put on and take off, and which takes up minimal space when carried or not in use, in short constituting a useful accessory in the habitual dressed employed in this sport and in consonance with it.

More specifically, the safeguard element comprises an assembly of two units, one for each leg, each of which is made of a water-proofed textile material with the seams and shape necessary to surround the lower leg, over the shoe, and covering the whole perimeter of that part of the trousers, including the instep and malleolous, to the lower part of the calf, and somewhat higher at each inside leg, where greater protection is required at the top.

Each part or unit consists of a main part of water-proofed textile material such as canvas, gabardine or any other suitable waterproof textile, roughly rectangular in shape, and which may in turn be formed by a single or by several portions, sewn together, with one portion sewn to the first, approximately triangular in shape, of the same material or a stronger material of the waterproof leather or imitation leather type, designed to cover the area of the instep, like a bib.

This device may be attached to the trouser bottom in any one of very many ways, using standard means, preferably removable adhesives or hook and loop fastener e.g. textile materials, though others may be used which fulfil the same function, such as hook-and-eye, automatic devices, zips, tying or any other means providing suitable attachment features. These securing elements are arranged on the inside edge of the sides of the main textile component and may also be placed on the upper inside edge coinciding with the inside leg, so that the safeguard element is closed at the back of each leg, at the Achilles tendon, and is easy to remove and put on at any time.

The entire lower part of the trouser leg is thus covered, taking in the shoe upper, and protecting the area from soiling (sand, mud, grass, water, etc.) caused when playing this sport, and ensuring that elements from the golf course are unable to get between the shoe and sock while at the same time not creating any obstacle to the user's complete freedom of movement. They can be put on and removed with great ease and are simple to clean, after each day's play, so that they are clean and ready for use whenever needed, keeping the trousers clean and so significantly extending their useful life.

The assembly may be finished in a number of ways, with the same or different colours for the main part and that covering the instep, with the same or different texture for each, at all events with an appearance appropriate to the pursuit of this sport.

In short, said element has completely versatile characteristics which mean that, when not worn on the trousers, it can easily be kept in a trouser pocket, folded as well, or in the golf-bag.

When worn on the trousers and forming a single unit with it, this element can be simply sewn between the top of each safeguard element and the end of each leg, retaining the rear opening to make it easier to put on and to remove the trousers, even with the shoes on.

A BRIEF DESCRIPTION OF THE DRAWINGS

The features and benefits of the invention will become clear in the detailed description following of a preferential embodiment, given by way of illustration and without limitation, with reference to the attached drawings, in which:

FIG. 1 shows the outside of each unit of the safeguard element, fully opened, in this case that for the left leg.

FIG. 2 shows the inside of the same unit.

FIG. 3 is a side view of the inside of the player's left leg, with the safeguard device on.

A DESCRIPTION OF A PREFERENTIAL EMBODIMENT

Figure 3:
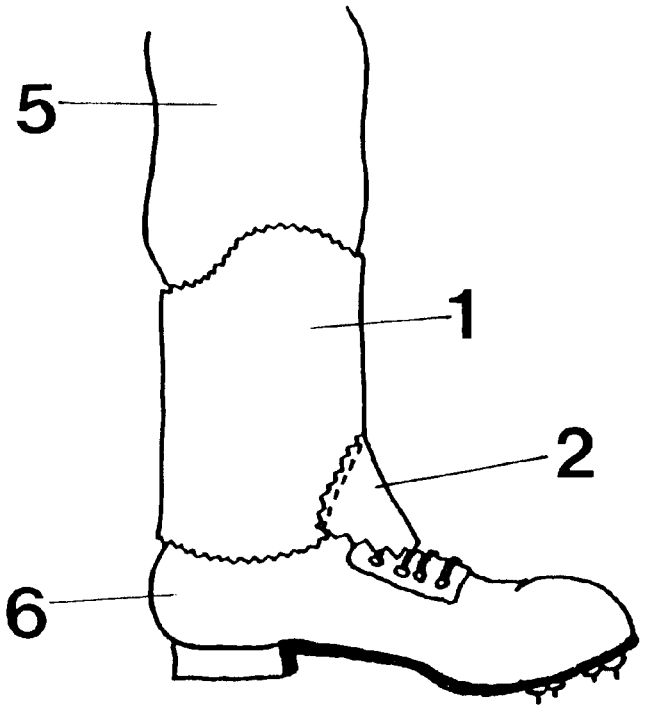
Figure 4:
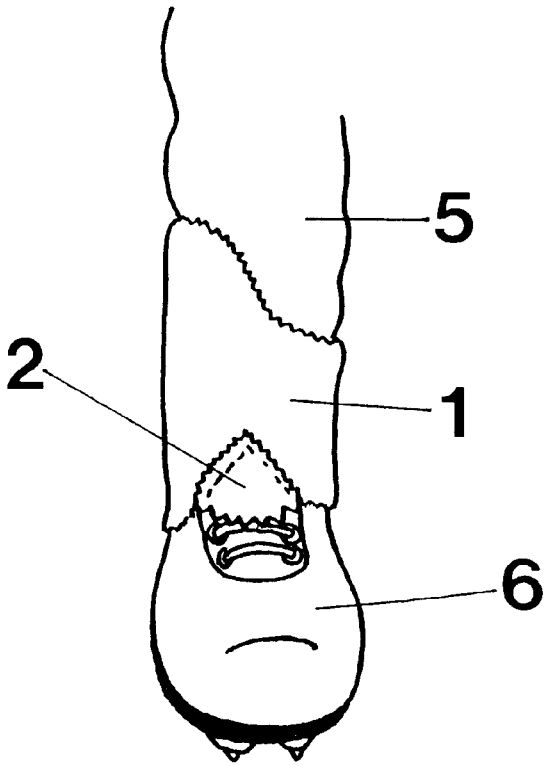
FIG. 4 is a face view of the same leg, with the safeguard element fitted.

The detailed description of the system put forward in the invention takes account of the representation shown in four figures of drawings, of the left foot unit from the set comprising the whole (one for each leg); the features of the other are identical or equal to this one. According to said figures, it is seen how the element developed by the invention is formed by a main portion of waterproof textile material (1) approximately rectangular in shape, higher at the part associated with the inside of the leg and which can in turn be formed by a single piece of material or by several units sewn together (4) with an inward peak at mid-bottom where a second portion (2) is attached, by seams (4) and which may be of the same or of a stronger material. Portion (1) is designed to surround the trouser leg (5) covering the perimeter and overlapping the shoe upper (6), reaching as far as the calf, and is higher inside the leg, while portion (2) covers the area of the instep, like a bib.

To secure it to the user's foot, on the inside of portion (1), coinciding with the edges, there are strips (3) of a material such as adhesive removable velcro or the like, allowing them to be closed and held by contact under light pressure, and to be pulled open easily.

Clearly, the device just described may be attached to the trouser using any other suitable means for such purposes, such as hook-and-eye, automatic devices, zips, elastic bands and even ribbons or conventional tying.

Equally obviously, although the attached drawings of the preferred embodiment show the entire edge of the safeguard element in serrated form, it may also be straight or take on any other design which does not affect its functionality.

It is not felt necessary to extend the content of this description in order for a specialist in the field to grasp its scope and the benefits arising from the invention, and to develop it and put it into practice.

The invention must nonetheless be understood to have been described in terms of a preferential embodiment and so may be the subject of modifications, particularly in terms of shape, size and/or the materials of which it is made, provided that this does not involve any alteration to its fundamentals.

What is claimed is:

1. A safeguard element for playing golf or other sport requiring similar protection, wherein said safeguard element is adopted for placing over trousers legs (5) and overlapping tops of shoes (6), wherein the element comprising two units, one for each leg and each comprising a main portion (1) of waterproof textile material, generally rectangular in shape, the rectangular shape having four edges and definining a plane when laid flat, one edge having a middle section which rises from said one in the plane and an inward angular section within the plane along another edge opposite the one edge, same or stronger material as compared to the main portion, largely triangular in shape and sewn (4) to the main portion (1) within the inward angular section, and incorporating devices for attachment to the leg in the form of strips (3) arranged on the inside edges of the main portion (1), the safeguard element is adopted to close at the rear in line with the Achilles tendon.

2. A safeguard element for playing golf as set forth in claim 1, wherein the main portion (1) of waterproof textile material is one or several pieces sewn together (4).

3. A safeguard element for playing golf as set forth in claim 1, wherein the strips (3) with the devices for attachment to the trousers may take the form of removable adhesive, hook and loop fastener, hooks and eyes, zips, ribbons or any combination of such attachments.

4. A safeguard element for playing golf as set forth in claim 1, which is directly incorporated into the trousers as an integral part, merely by sewing the upper edge of each unit to the end of each of the trouser legs.

5. A safeguard element for playing golf as set forth in claim 1, wherein the second portion is of waterproof leather or imitation leather.

* * * * *